US005823823A

United States Patent [19]

Longueville et al.

[11] Patent Number: 5,823,823

[45] Date of Patent: Oct. 20, 1998

[54] ELECTRICAL CONNECTOR ASSEMBLY

[75] Inventors: Jacques Longueville, Oostkamp, Belgium; Peter Pagnin, Munich, Germany

[73] Assignee: Siemens Aktiengesellschaft, Munich, Germany

[21] Appl. No.: 625,609

[22] Filed: Mar. 29, 1996

[30] Foreign Application Priority Data

Mar. 29, 1995 [DE] Germany ..... 195 11 508.2

[51] Int. Cl.[6] ..... H01R 13/73

[52] U.S. Cl. ..... 439/571; 439/260

[58] Field of Search ..... 439/571, 59, 60, 439/65, 260, 267, 328, 67

[56] References Cited

U.S. PATENT DOCUMENTS

| | | | |
|---|---|---|---|
| 3,130,351 | 4/1964 | Giel . | |
| 5,104,341 | 4/1992 | Gilissen et al. | 439/608 |
| 5,174,770 | 12/1992 | Sasaki et al. | 439/108 |
| 5,295,852 | 3/1994 | Renn et al. | 439/328 |

FOREIGN PATENT DOCUMENTS

| | | |
|---|---|---|
| 0377984 | 7/1990 | European Pat. Off. . |
| 0486298 | 5/1992 | European Pat. Off. . |
| 3014172 | 12/1983 | Germany . |
| 4040551 | 6/1991 | Germany . |

OTHER PUBLICATIONS

"Frisierter" Sipac–Stecker (Zell), Markt & Technik No. 26, Jun. 24, 1993, pp. 36–37.

Hochpolig und geschirmt: Metrisches . . . (Heilmann), Components 30, No. 5, 1992, pp. 189–192.

*Primary Examiner*—Khiem Nguyen
*Assistant Examiner*—Eugene Byrd
*Attorney, Agent, or Firm*—Herbert L. Lerner; Laurence A. Greenberg

[57] ABSTRACT

An electrical connector assembly includes an electrical connector having a connected position and contacting devices in the electrical connector for electrically contacting terminals of devices external to the electrical connector. The assembly also includes devices for holding the electrical connector in the connected position while the contacting devices are electrically connected. Furthermore, the contacting devices and the devices for holding the electrical connector are spatially separate from one another. One embodiment of the electrical connector is for connecting first and second printed circuit boards.

25 Claims, 6 Drawing Sheets

ELECTRICAL CONNECTOR ASSEMBLY

BACKGROUND OF THE INVENTION

FIELD OF THE INVENTION

The invention relates to an electrical connector for connecting contacting devices of external terminals.

Such electrical connectors, intended for connecting two printed circuit boards or for connecting a printed circuit board to some other device, are known in great variety.

As a representative example, reference may be made in this connection, for instance, to the 2.5 mm family of plug connectors known as SIPAC, made and sold by the present applicant. Descriptions of the basic model and of further developments in this electrical connector have been published in "Components", 30 (1992), No. 5, pp. 189–192 and in "Markt und Technik—Wochenzeitung für Elektronik" (Market and Technology—Electronics Weekly) No. 26, Jun. 24, 1994, pp. 36–37.

As may be learned from the above publications, a tremendous effort has recently been devoted to making the known electrical connectors HF-compatible. As a rule, compatibility is achieved by providing additional ground terminals and/or shields.

For instance, the signals may be transmitted only over every other contact, while the intervening contacts are connected to ground. The increased number of ground terminals means that the number of poles of the electrical connector must be drastically increased, resulting in the attendant negative effect on the size and manipulability of the electrical connector.

The above example is similar to the description of an HF-compatible electrical connector disclosed in DE 40 40 551 C2. According to that patent, a shielding element is inserted between the vertical terminal rows of a female multipoint connector in such a way that of the five available rows of contacts, only three rows are usable for signals, while two rows are connected to ground.

From European Patent Disclosure EP 0 486 298 A1, finally, a connector configuration is known in which ground contacts each offset by one-half the spacing are disposed between signal contacts, so that in the inserted state, the signal contacts are surrounded by ground contacts. In that embodiment, while the size of the electrical connector can remain substantially constant, nevertheless the number of poles once again increases quite considerably.

The above-described known HF-compatible electrical connectors have the disadvantage that additional ground contacts must always be provided, leading to a considerable increase in the total number of contacts to be contacted.

That circumstance, and the fact that with technological progress the number of signals to be transmitted and thus both the number of transmission lines and the speed of transmission are certainly on an upward rather than a downward trend, has the consequence that manipulation of conventional electrical connectors is becoming more and more difficult and expensive.

The higher the polarity of the conventional electrical connectors, the more force that must be exerted to plug them in and pull them out from contact strips, such as male or female multipoint connectors used for contacting purposes.

Actuation aids are indeed available that reduce the force the user must exert, but the forces to be exerted in the meantime are increasingly no longer easily accomplished by a user.

A further factor is that the requisite exertion of force for inserting the electrical connector into and removing it from a contact strip of a printed circuit board unavoidably leads to deformation of the printed circuit board to be connected or disconnected, and thus threatens damage of the components mounted on the printed circuit board, especially surface mounted devices.

Until now, the deformation of the printed circuit boards was prevented through the use of reinforcement rails additionally provided on them.

The actuation aids and reinforcing rails, which must be made ever stronger, are increasingly more complicated to manipulate and furthermore entail not inconsiderable additional costs for manufacture and maintenance of the electrical connection and the components to be connected.

SUMMARY OF THE INVENTION

It is accordingly an object of the invention to provide an electrical connector assembly, which overcomes the hereinafore-mentioned disadvantages of the heretofore-known methods and devices of this general type and which reduce to a minimum the force to be exerted to connect and disconnect the electrical connection.

With the foregoing and other objects in view there is provided, in accordance with the invention, an electrical connector assembly, comprising: an electrical connector having a connected position; contacting devices in the electrical connector for electrically contacting terminals of devices external to the electrical connector; and devices for holding the electrical connector in the connected position while the contacting devices are electrically connected, the contacting devices and the devices for holding the electrical connector being spatially separate from one another.

With the objects of the invention in view, there is also provided an electrical connector assembly for connecting first and second printed circuit boards, comprising: an electrical connector having a connected position; contacting devices in the electrical connector for electrically contacting terminals on the printed circuit boards; and devices for holding the electrical connector in the connected position while the contacting devices are electrically connected, the contacting devices and the devices for holding the electrical connector being spatially separate from one another.

It is accordingly provided that the contacting devices of the electrical connector and the devices for holding the electrical connector in the connected position are provided spatially separated from one another.

In other words, in the electrical connector of the invention, a connection that is entirely different from conventional electrical connectors is achieved. In the conventional electrical connectors, that is, the electrical connectors with male and female multipoint connectors, the connection of the contacting devices to be contacted simultaneously creates both an electrical and a mechanical connection. If one wished, for instance, to make the electrical connection safer and more reliable by more firmly joining the contacting devices, the mechanical connection would automatically be strengthened.

In the present invention, the electrical connection and the elements that accomplish the mechanical retention in the connected position are entirely separate from one another.

This separation affords the opportunity of dimensioning and constructing the electrical and the mechanical connection entirely independently of one another. That is, the electrical connection can be made reliable and safe in an arbitrary way, without automatically also having to increase the forces that must be brought to bear to connect and/or disconnect the connection; these forces are instead adjustable entirely independently of the electrical connection.

The electrical connector according to the invention thus affords the possibility of establishing a reliable and safe electrical connection and at the same time reducing the force to a minimum that must be brought to bear in connecting and disconnecting an electrical connection.

In accordance with an added feature of the invention, the first and second printed circuit boards have surfaces, the electrical connector being mounted substantially perpendicularly to the surface of one of the first and second printed circuit boards.

In accordance with an additional feature of the invention, the devices for holding include guiding and retaining walls disposed on the surface of one of the first and second printed circuit boards, the guiding and retaining walls guiding the electrical connector when the electrical connector is being mounted on the one of the first and second printed circuit boards, the guiding and retaining walls holding the electrical connector when the electrical connector is in the connected position.

In accordance with another feature of the invention, the electrical connector has a housing with recesses formed therein, the guiding and retaining walls having locking devices engaging the recesses of the housing.

In accordance with a further feature of the invention, one of the first and second printed circuit boards has top and bottom surfaces, the electrical connector being mounted substantially parallel to the top and bottom surfaces of the one printed circuit board.

In accordance with again an added feature of the invention, the electrical connector contacts the one printed circuit board on the top and bottom surfaces in the connected position.

In accordance with again an additional feature of the invention, the electrical connector includes first and second halves which, in the connected position, are disposed symmetrically around the one printed circuit board.

In accordance with again another feature of the invention, the devices for holding include a retaining mechanism, the first and second halves being retained in the connected position by the retaining mechanism, and the first and second halves are pivotally mounted for pivoting open upon release of the retaining mechanism.

In accordance with again a further feature of the invention, the assembly includes a pivot device for pivoting open the first and second halves relative to one another.

In accordance with yet an added feature of the invention, the electrical connector has a mounting position different from the connected position, the first and second halves pivot away from one another into the mounting position, and pivot toward one another into the connected position.

In accordance with yet an additional feature of the invention, the first and second halves, in the connected position, clamp the one printed circuit board therebetween.

In accordance with yet another feature of the invention, the electrical connector includes protrusions and the one printed circuit board has recesses formed therein, the protrusions engaging the recesses when the electrical connector is in the connected position.

In accordance with yet a further feature of the invention, the contacting devices have contact surfaces and the terminals of the printed circuit boards have contacts, the contact surfaces contacting the contacts in a substantially overlap-free manner.

In accordance with still an added feature of the invention, the contacting surfaces of the contacting devices have a greater length in a direction perpendicular to an intended flow of current than in a direction parallel to the intended flow of current.

In accordance with still an additional feature of the invention, the contacting surfaces have a substantially flat or curved shape for large-area contacting.

In accordance with still another feature of the invention, the contacting devices include elastic elements connected to the contacting surfaces, the elastic elements biasing the contacting surfaces towards the contacts on the printed circuit boards when the electrical connector is in the connected position.

In accordance with still a further feature of the invention, the elastic elements exert a contact-pressure force on each of the contacting surfaces, the contact-pressure force pushing the contacts of the printed circuit boards in a direction away from the electrical connector.

In accordance with an added feature of the invention, the contact-pressure forces pushing on the contacts are oriented in a substantially equal direction.

In accordance with an additional feature of the invention, the terminals of the printed circuit boards are substantially flat contact pads.

In accordance with another feature of the invention, the contacting devices include connectors and contacts, the electrical connector having channels formed therein extending continuously from one of the contacts to a respectively associated one of the contacts in the connected position, the connectors being guided in the channels.

In accordance with a further feature of the invention, the channels of the electrical connector have walls constructed from a material containing metal.

In accordance with again an added feature of the invention, the walls of the channels are electrically connected to ground.

In accordance with again an additional feature of the invention, the contacting devices include retainers for retaining the connectors in the channels and preventing displacement of the connectors along the channels, while otherwise permitting partial displacement thereof.

In accordance with again another feature of the invention, the one of the walls of the channels is an impedance-determining wall, each of the connectors having a constant spacing from a respective one of the impedance-determining walls as the electrical connector is transformed to the connected position.

Other features which are considered characteristic for the invention are set forth in the appended claims.

Although the invention is illustrated and described herein as embodied in an electrical connector assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 shows a schematic cross-sectional view of an exemplary embodiment of the electrical connector of the invention in the connected state.

DESCRIPTION OF THE PREFERRED EMBODIMENTS

Figure 1:
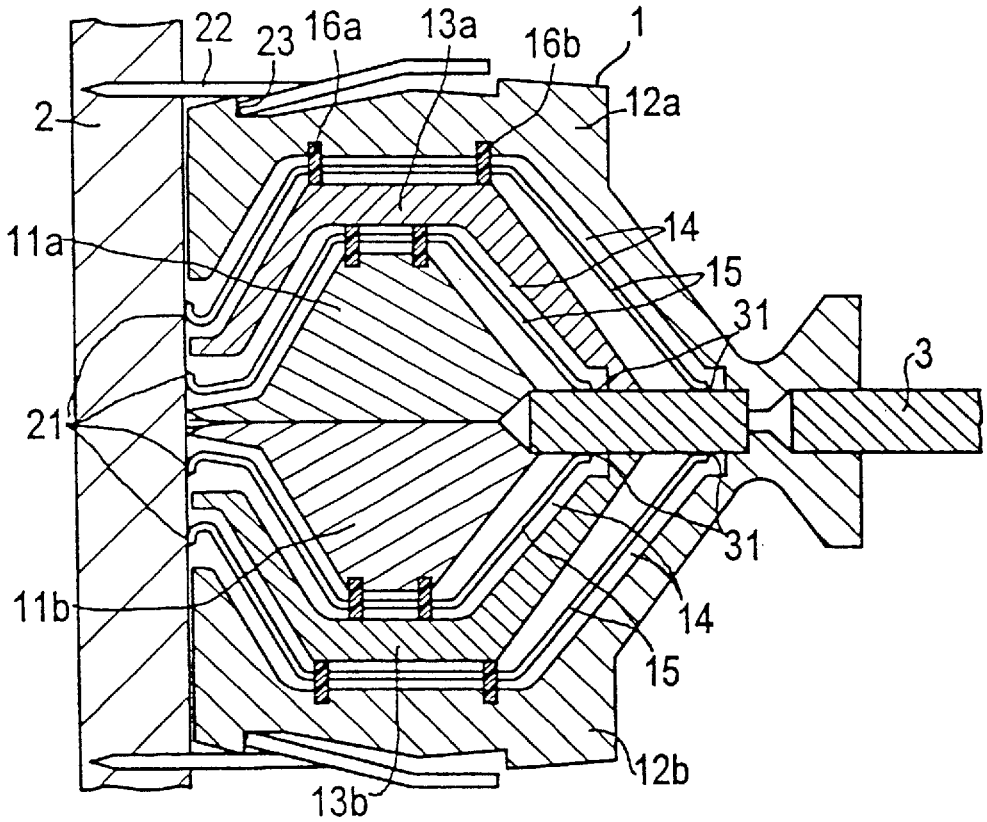
FIG. 1 is a diagrammatic, cross-sectional view of a preferred embodiment of an electrical connector according to the invention connected with a backplane printed circuit board and a module printed circuit board.

Referring now to the figures of the drawings in detail and first, particularly, to FIG. 1 thereof, there is seen an electrical connector 1 for connecting a surface of a backplane printed circuit board 2, or simply backplane board, and a module printed circuit board 3, or module board. The module board 3 is mounted on the surface of the backplane 2 with the electrical connector 1 between the module board 3 and the backplane 2 in a connected position. The backplane board 2 and the module board 3 may together be viewed as first and second printed circuit boards.

The electrical connector 1 closes symmetrically around a contact segment of the module board 3 in the connected position. The electrical connector 1 has two symmetrical halves, an upper half and a lower half, which are layered or have a sandwich structure.

One of the symmetrical halves, the upper half, includes a base 11*a* located in the center of the electrical connector 1, a cap 12*a* located on the outside of the electrical connector 1, and a middle element 13*a*. The other symmetrical half, the lower half, includes a base 11*b* located in the center of the electrical connector 1, a cap 12*b* located on the outside of the electrical connector 1, and a middle element 13*b*.

The middle elements 13*a*, 13*b* in the preferred embodiment illustrated in FIG. 1 have an arbitrary number of recesses forming channels 14 formed on both the side proximal the caps 12*a*, 12*b* and on the side proximal the bases 11*a*, 11*b*.

Connectors 15, to be described in further detail hereinafter, are disposed in the channels 14 and are provided for electrical contacting and connection of the backplane and module boards.

Figure 2:
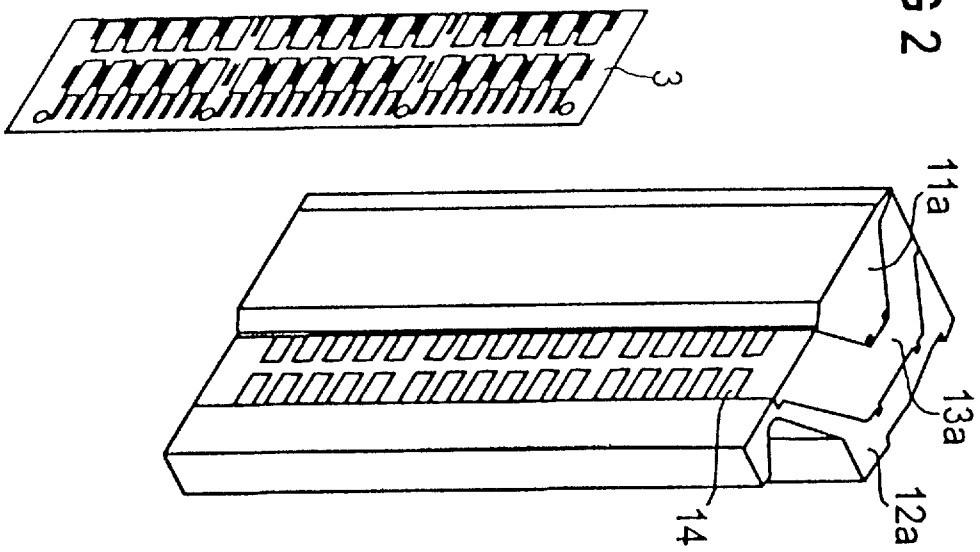
FIG. 2 is a perspective view of one symmetrical half of the electrical connector.
Figure 3:
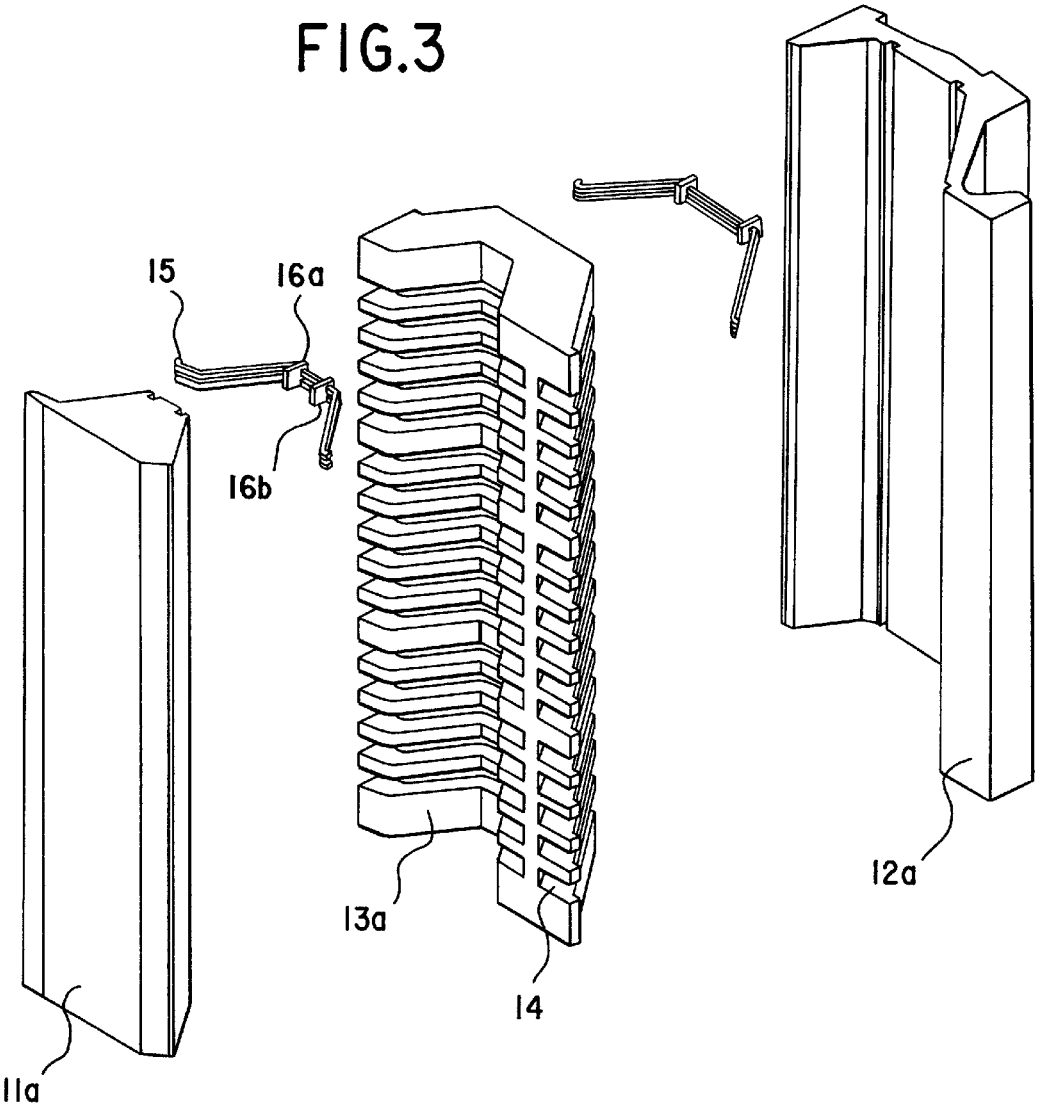
FIG. 3 is an exploded, perspective view of the one symmetrical half of the electrical connector.

The layout, configuration and function of the middle elements 13*a*, 13*b*, channels 14, and connectors 15 are further illustrated in FIGS. 2 and 3. FIG. 2 illustrates a perspective view of the upper symmetrical half of the electrical connector 1 and FIG. 3 is an exploded perspective view of the upper symmetrical half of the electrical connector 1.

FIGS. 2 and 3 clearly illustrate the channels 14 which are formed by placing the middle element 13*a*, having recesses on two sides corresponding exactly to the channels 14, on the base 11*a* and the cap 12*a* on the middle element 13*a*. The channels 14 guide the connectors 15. The surface of the base 11*a* proximal the middle element 13*a* and the surface of the cap 12*a* proximal the middle element 13*a* are level or flat.

However, other options for forming the channels 14 in the electrical connector 1 are conceivable. For example, the cap and/or base could be provided with recesses on the sides proximal the middle element in addition to the middle element having recesses. In order to form a channel 14, the middle element and the cap or base would then have to be put together in such a way that the respective recesses in the two connector components correspond to one another. Forming the channels with recesses in the middle element, the cap and/or the base has the advantage that the middle element can be made thinner and yet have the same stability, or can be made more stable and yet have the same thickness. Moreover, it is easier to make such middle elements because the recesses are not as deep.

Another option for forming the channels is that once again only the middle element has recesses, but the cap is provided with protrusions, which protrude into the recesses of the middle element. This option has the advantage that assembly of the electrical connector 1 is easier and the attainable precision can be increased.

As illustrated in the figures, particularly FIG. 3, the connectors 15 are adapted to the course of the channels 14 and are inserted into or suspended in the channels 14.

Each of the connectors 15 is provided with two retainers 16*a*, 16*b*, which prevent displacement of the connector along the channel 14 when the electrical connector 1 is assembled. A motion of the respective ends of the connectors, however, is still possible and indeed even desirable, as will be described in further detail below.

In the preferred embodiment, the connectors 15 are constructed as thin, resilient strips. The retainers 16*a*, 16*b* and the connectors of the preferred embodiment make it possible for the connectors 15 to be forced elastically out of the connector to a certain extent at their respective ends when the electrical connector is in a mounting position or not connected to a particular printed circuit board as clearly illustrated in FIG. 8, which will be further described hereinafter. If, however, the electrical connector is in a connected position or connected to a given printed circuit board, the connectors 15 are pressed back into the electrical connector as illustrated in FIG. 1. In the connected position of the electrical connector, the connector 15 exerts a substantially frontally acting contact pressure force on the given printed circuit board or biases the given printed circuit board, which as will be described in further detail below has a not inconsiderable significance for the reliability of the contacting to be accomplished.

The connectors 15 serve to make an electrical connection between contacting devices of the backplane and the module board. Hence, on one hand, the connectors are good electrical conductors, and on the other they are each constructed on their ends with a contact surface, enabling electrical contacting, these surfaces acting as contacting devices.

As can be seen from FIG. 1, the backplane 2 has contact pads 21 on the surface proximal the electrical connector for contacting devices, which for the sake of improved contact are preferably gold-plated.

As can be seen from FIG. 1 and partially from FIG. 3 as well, the module board 3 has contacting devices, contact pads 31, on both the upper and lower surface, corresponding to the contact pads 21.

The electrical connection of the backplane 2 to the electrical connector 1 and the electrical connection of the module board 3 to the electrical connector 1 are accomplished by pressing the contacting devices of the electrical connector 1 onto the contact pads 21 and 31 of the respective printed circuit board.

The connectors 15, as already noted above, are constructed as resilient strips in a preferred embodiment. When the electrical connector is in the connected position, the connectors 15 are deflected out of their position of repose and press back into the channels 14.

Figure 4:
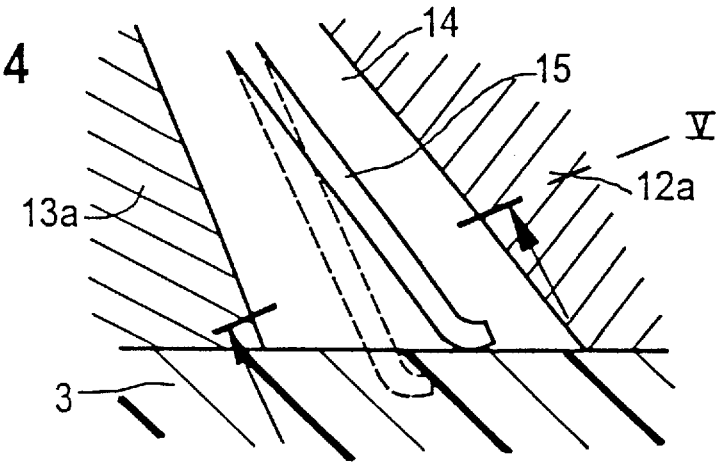
FIG. 4 is an enlarged, fractional, cross-sectional view of the electrical connector adjacent the module printed circuit board.

The deflection of the connectors 15 is illustrated in detail in FIG. 4.

FIG. 4 illustrates the connected state between the electrical connector 1 and the module board 3. In the connected state, the connector 15 is deflected out of the position of repose, which is represented by dashed lines in FIG. 4, and exerts a contact-pressure force on the module board 3, or more specifically on the associated contact segment on the module board.

In the position of repose, the connector 15 protrudes beyond the surface of the electrical connector toward the module board 3. Upon connection, the connector 15 is pressed back into the channel 14 counter to the spring force of the electrical connector.

Figure 5A:
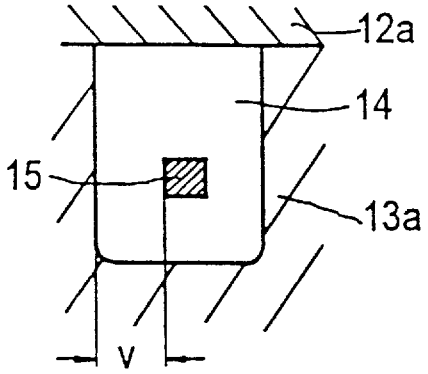
FIG. 5*a* is an enlarged, fractional, sectional view of a connector in a channel of the electrical connector in a disconnected position, which is taken along the lines V—V of FIG. 4. in the direction of the arrows.
Figure 5B:
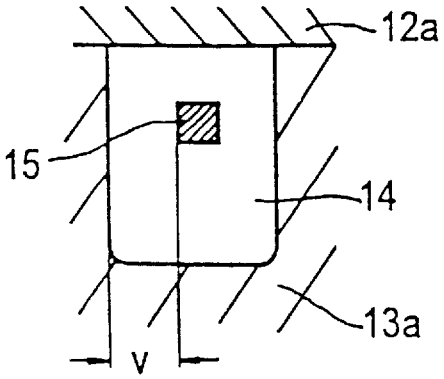
FIG. 5*b* is an enlarged, fractional, sectional view of the connector in a channel of the electrical connector in a connected position, which is taken along the lines V—V of FIG. 4. in the direction of the arrows.

The motion of the connector occurring relative to the walls of the channel, which motion is allowed by the retainers 16*a*, 16*b*, is advantageously constructed in such a way that the spacing between the connector 15 and the impedance-determining wall of the channel remains constant as illustrated in FIGS. 5A and 5B.

FIGS. 5A and 5B are fractional, sectional views of the electrical connector, which is taken along the line V—V of FIG. 4 in the direction of the arrows.

FIG. 5*a* illustrates the electrical connector in the mounting position or the state in which it is not connected to the module board 3. FIG. 5*b* illustrates the electrical connector in the connected position or in the state in which it is connected to the module board.

As illustrated in FIGS. 5*a* and 5*b*, the connector 15 assumes different positions inside the channel 14 depending on the current state or position of the electrical connector.

However, despite the different positions of the connector in the channel 14, the spacing of the connector 15 from the impedance-determining wall of the channel 14 remains constant when the connector changes position inside the channel 14. In the present exemplary embodiment the impedance-determining wall is the left-hand wall 33 of the channel 14 and the spacing constant is v as illustrated in FIGS. 5*a* and 5*b*.

This sort of defined motion of the connector 15 inside the channel 14 has the advantage that even if, because of contacting devices that have not been processed or manufactured exactly identically, the connector 15 is displaced variously far inside the channel 14 when the electrical connector is in the connected position, the desired impedance can still be precisely adhered to at all times for all the connectors. Moreover, a desired impedance of the electrical connector can be established extremely simply and even before installation of the electrical connector into an appliance.

The backplane 2 and the module board 3 may have bulwark-like bumps, non-illustrated in the figures, around the contact pads 21 and 31. These bumps are made of dielectric material, preferably by spray-coating with plastic, and serve to guide the contact surfaces of the contacting devices of the electrical connector exactly to the contact pads of the contacting devices of the respective printed circuit boards and durably keep them in this position, or detent position, accurately defined by the bump. Thus, even if imprecisely manufactured printed circuit boards and/or electrical connectors are used, a safe and secure electrical contact can always be obtained.

As illustrated particularly in FIG. 1, the connectors 15 are guided continuously in channels 14, which are closed on all sides, over the entire distance from the backplane 2 to the module board 3 when the electrical connector is in the connected position or in the connected state.

In one embodiment according to the invention, the housing parts of the electrical connector, i.e. the bases, middle elements and caps, are constructed from metal, metal-coated materials, or metal-containing materials such as metallized plastics or plastics with metal inlays. If the housing parts of the electrical connector in this embodiment are connected to ground, the connectors 15 are guided in shielded tunnels or channels, in a manner similar to a coaxial line.

Figure 6A:
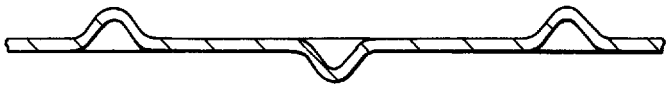
FIG. 6*a* is a cross-sectional view of a contact strip of the electrical connector in a non-contacting position.
Figure 6B:
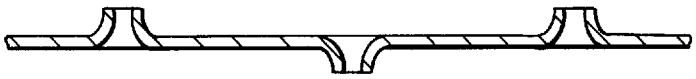
FIG. 6*b* is a cross-sectional view of a second embodiment of a contact strip in a non-contacting position.
Figure 6C:
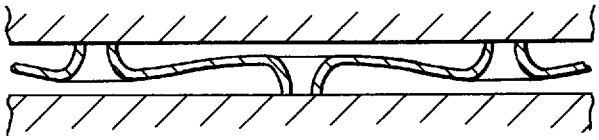
FIG. 6*c* is a cross-sectional view the second embodiment of a contact strip in a contacting position between two surfaces.

Connecting the housing of the electrical connector to ground is effected through additional contact surfaces on at least one of the printed circuit boards to be contacted, and preferably with the interposition of contact strips, illustrated in FIGS. 6*a*–6*c*, between the respective printed circuit board and the electrically conductive connector housing.

FIGS. 6*a* and 6*b* illustrate different embodiments of a contact strip in a position of repose or, in other words, in the disconnected state. Conversely, FIG. 6*c* illustrates the contact strip of FIG. 6*b* in a connected state or a state in which it is fastened between two surfaces to be contacted.

A common feature of the embodiments of the contact strip of FIGS. 6*a* and 6*b* is that they have high-density wavelike deformations with resilient properties, which in the connected state have the tendency to return to their position of repose again.

As illustrated particularly in FIG. 6*c*, when the contact strip is compressed or in the connected state, many contact points on which contact pressure is elastically exerted result between the surfaces to be contacted, enabling good, reliable contacting.

As has been explained, the electrical connection of the electrical connector to the various printed circuit boards occurs through the use of an indirect or direct, substantially frontal pressing together of the contact surfaces, facing one another substantially parallel both in the disconnected state and in the connected state, for the useful signals and the ground connection.

In contrast to the male and female connector strips conventionally used as contacting devices, the electrical connector according to the invention and the respective printed circuit boards to be contacted by the electrical connector are biased against one another or pressed away from one another by this contact-pressure force, bringing about a safe and reliable contacting.

This can be exploited to create an entirely new type of electrical connector, in which the quality of the electrical connection is not inseparably associated with the force that must be brought to bear to connect and disconnect the electrical connection.

In conventional electrical connectors, that is electrical connectors with male and female multipoint connectors, the electrical and the mechanical connection are coupled with one another, because the contact surfaces of the electrical connectors are simultaneously constructed as mechanical retaining elements that firmly keep the connector in its connected position.

Since now, however, as described in detail above, a contacting device has been discovered in which this is precisely not the case, the conventional coupling between the electrical and the mechanical connection can now be dissolved.

To that end, it is necessary to provide devices or auxiliary devices for maintaining the electrical connector in a mechanically connected position, which are spatially and/or functionally separate from the above-described electrical contacting devices of the electrical connector.

To that end, as illustrated in FIG. 1, the backplane 2 has guiding and retaining walls 22 with locking devices 23 for maintaining the electrical connector 1 in the mechanically connected position.

Figure 7:
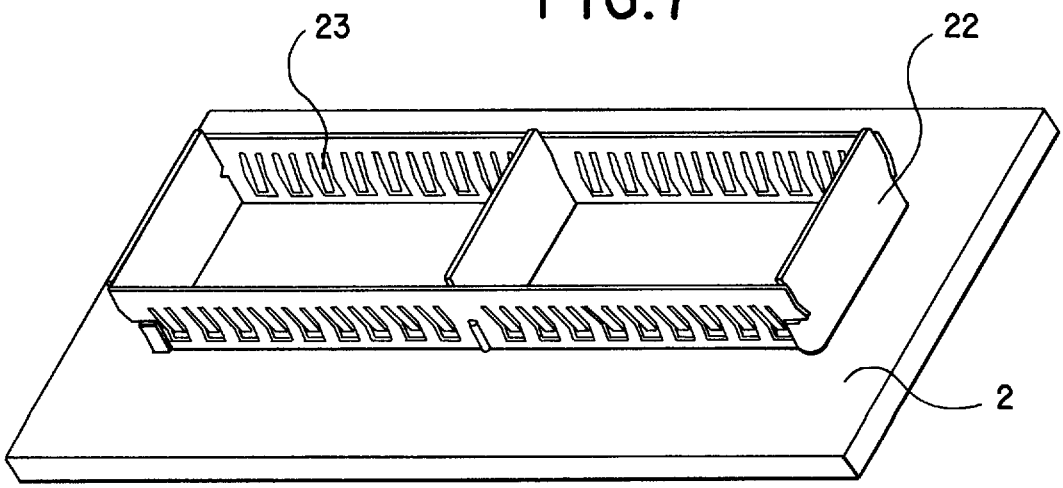
FIG. 7 is a perspective view of guiding and retaining walls with locking devices for the electrical connector on a backplane printed circuit board.

A perspective view of these guiding and retaining walls 22 with the locking devices 23 is illustrated in FIG. 7.

As can be seen from FIG. 7, the guiding walls 22 have many locking devices 23.

The locking devices 23 are constructed as resilient retaining tabs, which in the connected state where the electrical connector is connected to the backplane 2 engage corresponding recesses of the electrical connector and maintain the electrical connector in defined fashion in this position, counter to the biasing or contact-pressure forces acting on the contact surfaces.

In this way, a safe electrical connection on one hand and a safe mechanical connection on the other is assured between the backplane and the electrical connector through the use of different devices.

Despite the safe and reliable mechanical maintenance of the electrical connector in the connected position as described, the electrical connector can be removed or mechanically disconnected from the backplane without exertion of force by suitable actuation of the locking devices 23. No force is necessary because once the locking devices are actuated, the contacting devices to be contacted, on one hand, do not hold one another firmly. On the other hand, as illustrated in FIG. 1, no force is necessary because the guiding and retaining walls 22 of the backplane are constructed in such a way that no significant forces are formed such as frictional forces and the like, which counteract the removal of the electrical connector.

In order to provide a connection that is safe and reliable, on one hand, but is easy to disconnect, on the other, between the module board 3 and the electrical connector 1, the symmetrical halves, the upper and lower halves, of the electrical connector that enclose the module board 3 and contact the module board 3 on both sides are movable relative to one another in such a way that they can assume two defined positions by which the stated demands can be met.

In order to explain the two defined positions, reference will be made below in particular to FIG. 1, already described at the outset, and to FIG. 8.

Figure 8:
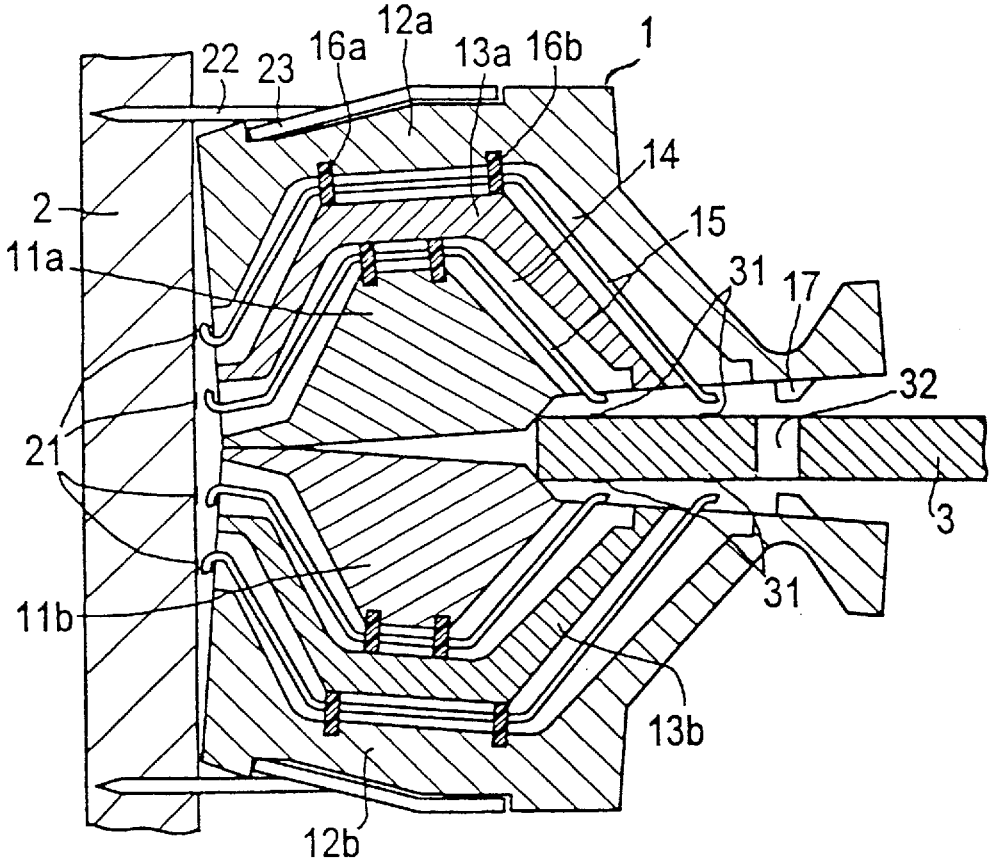
FIG. 8 is a cross-sectional view of the electrical connector in a mounting position.

FIG. 8 illustrates a cross-sectional view of the electrical connector in a mounting position, whereas FIG. 1 illustrates a cross-sectional view of the electrical connector in a connected position.

In the connected position illustrated in FIG. 1, the module board 3 is maintained in a defined position between the halves of the electrical connector, and both the contact surfaces of the connectors 15 of the electrical connector, used for transmitting useful signals, and the contact surfaces of the electrical connector that are provided for connecting the connector housing to ground, this latter with the interposition of the aforementioned contact strips, are pressed against the corresponding contact pads 31 of the module board 3.

In the mounting position illustrated in FIG. 8, the halves of the electrical connector are moved apart from one another or are open at the end toward the module board 3. As the halves open, or, in other words, when the electrical connector is mechanically disconnected from the module board 3, the electrical connections between the electrical connector and the module board are simultaneously, practically and automatically released as well without any additional expenditure of force. The module board 3, therefore, becomes entirely freely movable for removal from the electrical connector or insertion of it into the electrical connector. In the present exemplary embodiment illustrated in FIG. 8, all the electrical connections between the electrical connector and the backplane are also disconnected in the mounting state.

However, electrical disconnection of the backplane need not necessarily be the case. Instead, what is decisive in this regard is that the electrical and mechanical connections between the electrical connector and the module board are released enough that the module board can be removed or inserted without expending force.

In order to hold the module board 3 in a precisely defined position, the electrical connector, in the connected position, has a recess, formed by a suitable embodiment of the respective caps and middle elements, for receiving the module board between the halves of the electrical connector illustrated particularly in FIGS. 1 and 8, but partly in FIG. 3 as well. The electrical connector also includes a printed circuit board stop formed by the bases 11*a* and 11*b* and locking protrusions 17, illustrated in FIG. 8, provided on the halves of the electrical connector.

In the connected position of the electrical connector, the recess in the electrical connector provided for the printed circuit board has a thickness substantially equivalent to the thickness of the printed circuit board to be contacted. Preferably, the recess is dimensioned in such a way that the printed circuit board to be contacted is clamped between the halves of the electrical connector in the connected state thereof.

The locking protrusions 17 protrude into corresponding recesses 32 of the module board 3 in the connected position of the electrical connector, and, therefore, contribute to immovably locking the printed circuit board at a precisely defined position when the electrical connector is in the connected position.

In order to assure that the halves of the electrical connector, which are movable relative to one another, will maintain the connected position, a non-illustrated retaining mechanism is provided, which in the connected position of the electrical connector is actuated in such a way that the halves of the electrical connector cannot leave the position they have assumed relative to one another in the connected position.

By way of example, the retaining mechanism may be a screw bolt or some structure functionally equivalent to the guiding and retaining walls 22 and the locking devices 23.

The module board is, thus, safely and reliably connected to the electrical connector when the electrical connector is in the connected position.

In the connected position of the electrical connector, however, it is not possible to disconnect the electrical connector and the module board or, in other words, remove the module board from the recess of the electrical connector without destroying the electrical connector and/or the module board.

Rather, the electrical connector must be put into the mounting position to remove the module board without destruction.

To that end, first the aforementioned non-illustrated retaining mechanism for locking the halves of the electrical connector in the connected position must be released.

Next, the halves of the electrical connector can be moved into the mounting position shown in FIG. 8, in which, as already mentioned above and as illustrated in FIG. 8, both the mechanical and the electrical connection between the electrical connector and the module board are disconnected, so that removal or replacement of the module board can be accomplished without difficulty.

Putting the electrical connector into or, in other words, transforming the electrical connector to the mounting position is accomplished in the present exemplary embodiment by flipping open the two hinged or pivotal halves of the electrical connector. In the present exemplary embodiment, when the electrical connector is in the mounting position, the electrical connector can be, or can continue to be, mounted or mechanically connected to the backplane.

As the halves of the electrical connector flip open, the respective halves rotate or pivot about ends of the locking devices 23 of the guiding and retaining walls 22. The ends of the locking devices 23 engage corresponding recesses of the electrical connector. The ends of the locking devices 23 and the corresponding recesses of the electrical connector may together be viewed as a pivot device.

Due to the variation in the outer shape of the electrical connector as it is flipped open, however, the location of the end portions of the locking devices 23 can also change, so that the aforementioned pivot points are not as a rule stationary pivot points.

When the upper half and the lower half of the electrical connector are flipped closed and open, the halves are pivoted about respective ends of the locking devices in the opposite direction from one another. Since the locking devices 23, each acting as pivot points, never leave the corresponding recesses in the connector housing, the halves of the electrical connector cannot fall out of the guiding and retaining walls 22 in either the connected position or the mounting position of the electrical connector.

In order for the electrical connector to transform or move to the mounting position while mounted on the backplane, the guiding and retaining walls 22 must also be constructed accordingly. As a result, the guiding and retaining walls 22 must have a flaring shape on an end remote from the backplane to provide the electrical connector with the open space required to flip open the halves, as especially illustrated in FIGS. 1 and 8 but also in FIG. 7.

Both in the described connection between the electrical connector and the backplane and in the described connection between the electrical connector and the module board, the elements that effect the electrical connection and those that effect the mechanical connection are spatially and functionally separate from one another.

As a consequence, the electrical connection and the mechanical connection can be constructed and dimensioned without any direct influence on one another and independently of one another.

The electrical connector according to the invention permits a reliable and safe electrical connection, while, at the same time, reducing to a minimum the force necessary to connect and disconnect the connection.

The above-described embodiments of the electrical connector refer to the transmission of asymmetrical signals, that is, the transmission of the signals through an inner conductor in the form of the connector and an outer conductor in the form of electrically conductive channel walls.

However, the electrical connector according to the invention can also be constructed to transmit symmetrical signals. In this case, two parallel inner conductors per channel in the form of two parallel-extending connectors are provided.

The provision of two connectors extending parallel in the channel requires a different setting and adherence to the impedance value. In this case, the impedance value is the result of the spacing between the two connectors and the spacing between the conductors and the channel walls.

A further modification of the invention relates to the generation of the force that presses the contact surfaces to be contacted against one another in the connected state.

In the embodiments described above, the assumption was always that this force is generated by the various connectors themselves.

Instead, or in addition, however, it may also be provided that the force be exerted by the various contacting devices of the external terminals or by auxiliary elements disposed at some arbitrary point.

The electrical connector described, because of the local and/or functional separation of electrical and mechanical connecting components, is actuatable virtually without force and nevertheless is extremely simple and inexpensive to make and mount.

Additional information with regard to the retaining mechanism may be found the copending application Serial No. (Attorney Docket No. GR 95 P 1113), which is hereby incorporated herein by reference.

We claim:

1. In an electrical connector assembly having first and second printed circuit boards to be connected together, the improvement comprising:

an electrical connector having first and second halves;

holding devices disposed on the first circuit board for receiving and securing said electrical connector;

said first and second halves pivoting relative to one another on the holding devices of the first circuit board between an open and closed position for receiving and securing the second circuit board; and contacting devices disposed in said electrical connector for electrically contacting terminals on the printed circuit boards when said electrical connector is in said closed position.

2. The electrical connector assembly according to claim 1, wherein the first and second printed circuit boards have surfaces, said electrical connector being mounted substantially perpendicularly to the surface of one of the first and second printed circuit boards.

3. The electrical connector assembly according to claim 2, wherein said holding devices include guiding and retaining walls disposed on the surface of the first printed circuit board, said guiding and retaining walls guiding said electrical connector when said electrical connector is being mounted on the first printed circuit board, said guiding and retaining walls holding said electrical connector when said electrical connector is in a connected position.

4. The electrical connector assembly according to claim 3, wherein said electrical connector has a housing with recesses formed therein, said guiding and retaining walls having locking devices engaging said recesses of said housing.

5. The electrical connector assembly according to claim 1, wherein one of the first and second printed circuit boards has top and bottom surfaces, said electrical connector being mounted substantially parallel to the top and bottom surfaces of the one printed circuit board.

6. The electrical connector assembly according to claim 5, wherein said electrical connector contacts the one printed circuit board on the top and bottom surfaces in the connected position.

7. The electrical connector assembly according to claim 6, wherein said first and second halves, in said closed position, are disposed symmetrically around the one printed circuit board.

8. The electrical connector assembly according to claim 7, wherein said holding devices include a retaining mechanism, said first and second halves being retained in said closed position by said retaining mechanism, and said first and second halves are pivotally mounted for pivoting open upon release of said retaining mechanism.

9. The electrical connector assembly according to claim 8, wherein, said first and second halves pivot away from one another into said open position, and pivot toward one another into said closed position.

10. The electrical connector assembly according to claim 7, wherein said first and second halves, in said closed position, clamp the one printed circuit board therebetween.

11. The electrical connector according to claim 7, wherein said electrical connector includes protrusions and the one printed circuit board has recesses formed therein, said protrusions engaging the recesses when said electrical connector is in said closed position.

12. The electrical connector assembly according to claim 1, wherein said contacting devices have contact surfaces and the terminals of the printed circuit boards have contacts, said contact surfaces contacting the contacts in a substantially overlap-free manner.

13. The electrical connector assembly according to claim 12, wherein said contacting surfaces of said contacting devices have a greater length in a direction perpendicular to an intended flow of current than in a direction parallel to the intended flow of current.

14. The electrical connector assembly according to claim 13, wherein said contacting surfaces have a substantially flat shape for large-area contacting.

15. The electrical connector assembly according to claim 13, wherein said contacting surfaces have a substantially curved shape for large-area contacting.

16. The electrical connector assembly according to claim 13, wherein said contacting devices include elastic elements connected to said contacting surfaces, said elastic elements biasing said contacting surfaces towards the contacts on the printed circuit boards when said electrical connector is in said closed position.

17. The electrical connector assembly according to claim 16, wherein said elastic elements exert a contact-pressure force on each of said contacting surfaces, the contact-pressure force pushing the contacts of the printed circuit boards in a direction away from said electrical connector.

18. The electrical connector assembly according to claim 17, wherein the contact-pressure forces pushing on the contacts are oriented in a substantially equal direction.

19. The electrical connector assembly according to claims 1, wherein the terminals of the printed circuit boards are substantially flat contact pads.

20. The electrical connector assembly according to claim 1, wherein said contacting devices include connectors and contacts, said electrical connector having channels formed therein extending continuously from one of said contacts to a respectively associated one of said contacts in the connected position, said connectors being guided in said channels.

21. The electrical connector assembly according to claim 20, wherein said channels of said electrical connector have walls constructed from a material containing metal.

22. The electrical connector assembly according to claim 21, wherein said walls of said channels are electrically connected to ground.

23. The electrical connector assembly according to claims 22, wherein said contacting devices include retainers for retaining said connectors in said channels and preventing displacement of said connectors along said channels, while otherwise permitting partial displacement thereof.

24. The electrical connector assembly according to claim 23, wherein one of said walls of said channels is an impedance-determining wall, each of said connectors having a constant spacing from a respective one of said impedance-determining walls as said electrical connector is transformed to the connected position.

25. The electrical connector assembly according to claim 1, wherein said contacting devices have contact surfaces and the terminals of the devices external to said electrical connector have contacts, said contact surfaces contacting the contacts in a substantially overlap-free manner.

* * * * *